United States Patent [19]

Keil

[11] Patent Number: 5,026,189

[45] Date of Patent: Jun. 25, 1991

[54] WRITING IMPLEMENT WITH COAXIAL ALTERNATELY USABLE TIPS

[75] Inventor: Georg Keil, Gross-Bieberau, Fed. Rep. of Germany

[73] Assignee: Firma Merz & Kreel GmbH & Co., Gross-Bieberau, Fed. Rep. of Germany

[21] Appl. No.: 505,875

[22] Filed: Apr. 5, 1990

[30] Foreign Application Priority Data

May 2, 1989 [DE] Fed. Rep. of Germany ..... 3914465

[51] Int. Cl.[5] ..... B43K 1/06; B43K 17/00; B43K 27/00

[52] U.S. Cl. ..... 401/29; 401/99; 401/198

[58] Field of Search ..... 401/199, 198, 99, 29, 401/19, 16, 20, 17, 22, 28, 34, 35, 195, 23, 116, 109, 196, 202

[56] References Cited

U.S. PATENT DOCUMENTS

| | | | |
|---|---|---|---|
| 2,591,027 | 4/1952 | Turnes | 401/19 |
| 3,247,828 | 4/1966 | Basham | 401/230 |
| 3,336,909 | 8/1967 | Diamond | 401/260 |
| 3,687,562 | 8/1972 | Basham | 401/198 |
| 4,410,290 | 10/1983 | Yamauchi | 401/199 |
| 4,580,918 | 4/1986 | Baker | 401/198 |

FOREIGN PATENT DOCUMENTS

| | | | |
|---|---|---|---|
| 62-62645 | 10/1965 | Japan | 401/199 |
| 2116915 | 10/1983 | United Kingdom . | |

*Primary Examiner*—Richard J. Johnson
*Attorney, Agent, or Firm*—Herbert Dubno; Andrew Wilford

[57] ABSTRACT

A writing utensil, in particular a fibre pen, marking pen or liner with two optionally usable, different writing tips is provided which are disposed at the same end of the writing utensil and nested into each other and can thus be jointly supplied by a writing material reservoir.

10 Claims, 3 Drawing Sheets

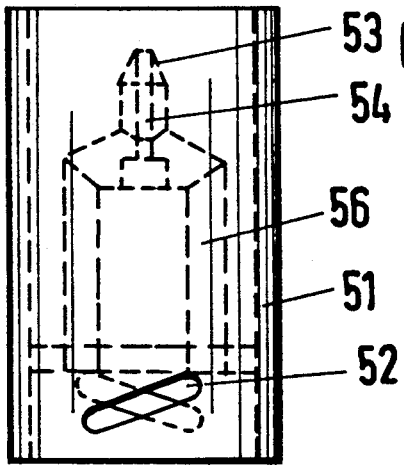
Fig.8
Fig.7
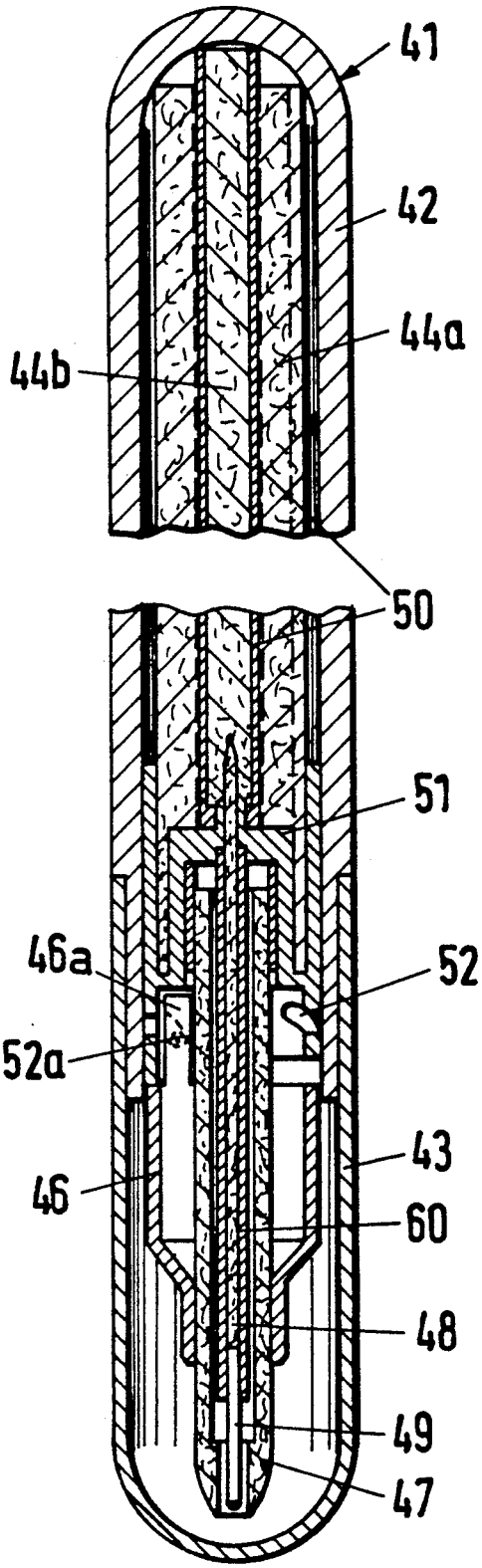
Fig.9
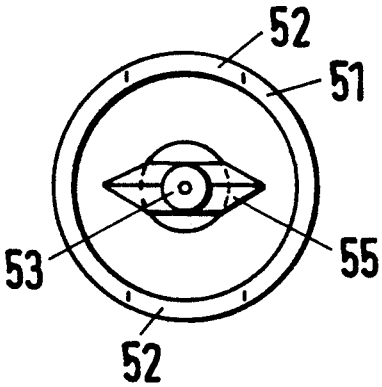
Fig.10
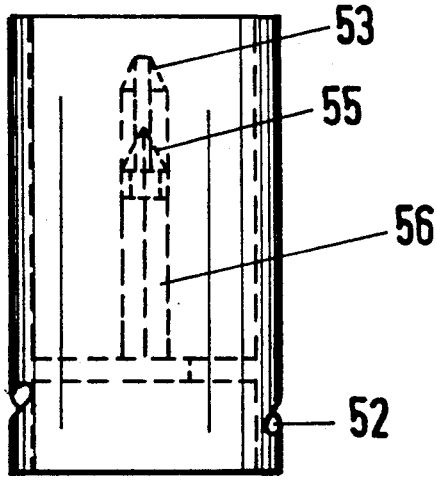

WRITING IMPLEMENT WITH COAXIAL ALTERNATELY USABLE TIPS

FIELD OF THE INVENTION

The invention relates to a writing implement, in particular a fiber pen, marking pen, liner or the like with two optionally usable, different writing tips which can be supplied from a common writing material reservoir.

BACKGROUND OF THE INVENTION

It is known in writing implements of this type to make lines of different thicknesses by a specific shaping of the writing tip projecting from the body of the implement. This is done by contacting differently shaped areas of the writing tip with the writing substrate in different positions of the writing tip with respect to the substrate. This handling is, on the one hand, tedious and also unsatisfactory inasmuch as it requires special skill to select the position of the writing implement necessary for the desired stroke or line thickness. The different areas of the writing tip, in particular that area for finer lines, quickly wears down or is destroyed due to the writing pressure, in particular in connection with a rough pad or writing substrate so that the writing implement can only be used for greater line thicknesses.

A writing implement is also known in which one writing tip is located in each of the two opposite ends of the body of the implement, both writing tips being of different thicknesses. Here, too, the handling is tedious, since in the case of changing line thickness the writing implement must be turned around. In addition there is the risk of a soiling hands or clothes with the rearwardly pointing writing tip which is not being used. Finally it became apparent that the supply of the writing tips of different thickness which are located at the opposite ends of the writing implement from a common writing material or ink reservoir is problematic and sufficient writing material is often only supplied to the writing tip of larger diameter after a short period of time.

OBJECTS OF THE INVENTION

It is the object of the invention to further develop a writing implement in such fashion that the disadvantages set forth above are reliably avoided, a more simple handling is made possible, a change in the line thicknesses must practically not be feared, and a reliable supply of ink to both writing tips from the common writing material reservoir is ensured until the writing material stock is used up.

SUMMARY OF THE INVENTION

A writing implement according to this invention has a hollow body extending along and centered on an axis, a reservoir tampon in the body holding a supply of ink, a casing fixed in the body over the reservoir tampon, and a small-diameter core writing element having a rear end fixed in and projecting rearwardly through the casing into the reservoir tampon and a front end. A sleeve is slidable axially in the body adjacent and around the core element. A large-diameter outer writing element is formed with a central throughgoing small-diameter bore through which the core element extends slidably. This outer element has a rear end fixed in the slidable sleeve and projecting into the reservoir tampon and a front end. The sleeve and outer element are axially jointly displaceable between a forward position with the front end of the outer element level with the front end of the core element and a rear position with the front end of the core element projecting axially outward past the front end of the outer element.

In this design different line thicknesses are not ensured by the shape of a writing tip, but by two separate writing tips which in each case are adapted to the desired line thicknesses. This means that the line thickness is practically not changed even in the case of a frequent use of the one or both writing tips. Handling is extremely simple since both writing tips are provided at the same end of the writing implement. Due to the fact that the two writing tips are nested in each other they are, on the one hand, largely protected against drying up, while, on the other hand, a reliable supply of both writing tips from the writing-material reservoir tampon is ensured until the writing material is used up.

A further advantage consists in that the two writing tips may be produced of different material, the writing tip of smaller diameter, having has a rule greater hardness. Due to this, the writing tip with smaller diameter nested into the writing tip with larger diameter can impart better support and a certain protection against premature wear to the larger writing tip and thus contribute to a longer service life of the larger writing tip.

Furthermore according to the invention the writing tip with smaller cross-section forms a part of the contact surface between the larger writing tip and the blotting-pad.

The large-diameter writing tip may be supplied from the writing material reservoir via the writing tip with smaller diameter since both are in large-surface mutual sliding contact due to their nesting in each other, so that the writing material can reliably pass into the large-diameter writing element under capillary action.

Alternatively to this or in addition to this, the reservoir tampon includes an outer part engageable only with the outer large-diameter element and saturated with an ink of a predetermined color, an inner part in which only the core element is engaged and which is saturated with an ink of a color different from that of the outer part, and an impervious sleeve separating the reservoir parts from each other so that both writing tips can also be directly supplied from the tampon, but with inks of different colors.

BRIEF DESCRIPTION OF THE DRAWING

The invention is explained in more detail in the following with reference to two embodiments and schematic drawings.

FIG. 7 is a section like FIG. 2 a second example of embodiment of the new writing implement;

FIG. 8 is a side view of the insert element of the implement of FIG. 7;

FIG. 9 is a front end view of the insert of the implement of FIG. 7; and

FIG. 10 is a lateral view of the insert but rotated by 90° as compared with FIG. 8.

SPECIFIC DESCRIPTION

Figure 1:
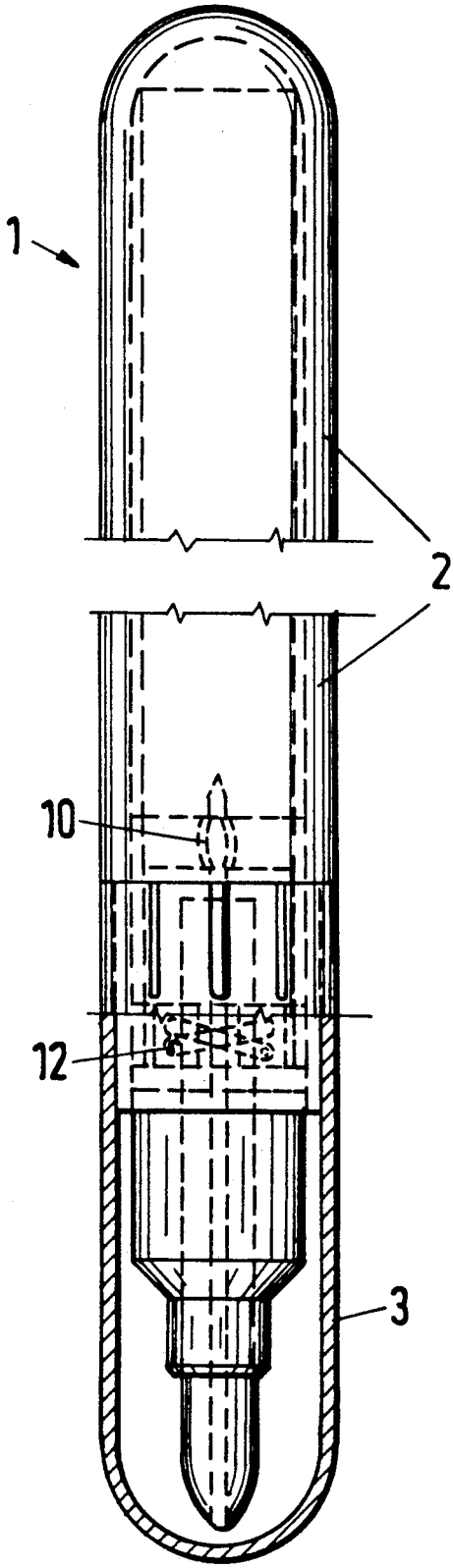
FIG. 1 is a side view, partly in axial section, of a writing implement according to the invention.
Figure 2:
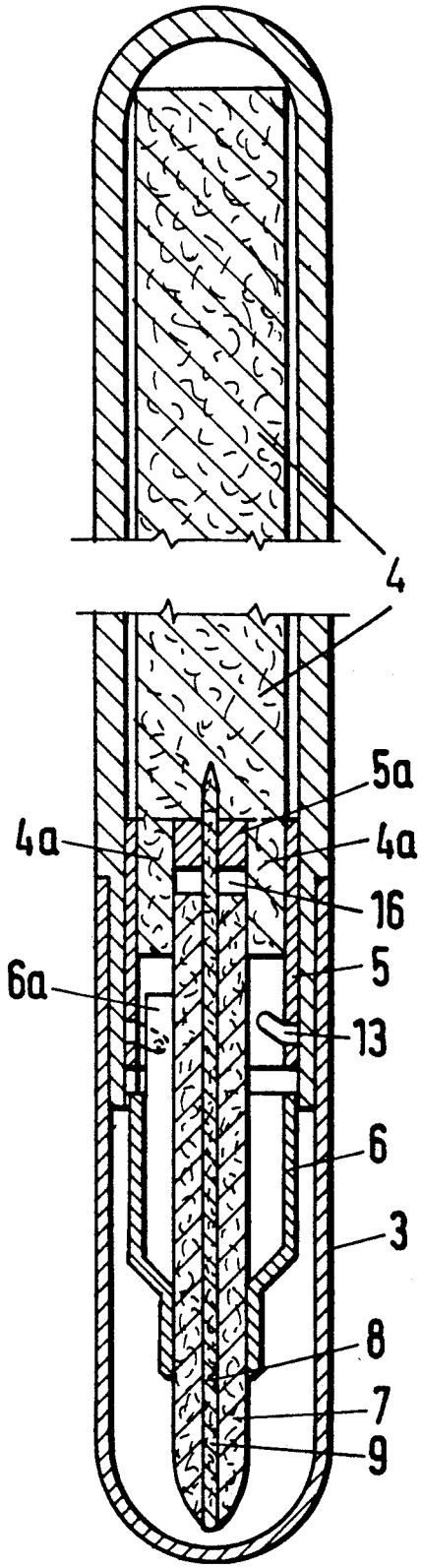
FIG. 2 is a longitudinal section along the axis of the writing implement in a plane vertical to the section plane of FIG. 1.

The writing implement 1 according to FIGS. 1 to 4 consists of a writing implement holder or body 2 having one end covered by a cap 3 and containing an ink-filled reservoir tampon 4. The cap 3 has an open end which can be elastically spread so it can be slipped onto the thicker closed end of the body 2 of the writing implement.

A tubular holding casing 5 is firmly inserted, possibly also glued, into the open end of the body 2 of the writing implement. The bottom of the casing 5 is formed by a transverse web 5*a*. The outer end of the writing material reservoir tampon 4 has a transverse recess 16 into which the transverse web 5*a* of the holding casing 5 fits. The reservoir tampon 4 can thus be inserted together with the holding casing 5 into the body 2 of the writing implement as a preassembled unit.

The inner end of an elongated writing tip 9 of small diameter is inserted at 10 into and fastened to the transverse web 5*a*. This inner end of the writing tip 9 projects beyond the transverse web 5*a* sufficiently into the writing material reservoir tampon 4 to allow the writing material or ink to reliably pass, if required, under capillary action into it.

The small-diameter writing tip 9 is received across the widest portion of its length with sliding fit in a longitudinal bore 8 of a tip 7 of larger diameter so that both writing tips 7 and 9 are concentrically nested in each other and are in contact with each other across the entire length of the bore 8, which engagement promotes the transfer of the writing material between them.

The large-diameter writing tip 7 is fitted through a holding sleeve 6 which closes the open front end of the body 2 of the writing implement and engages into the open front or outer end of the holding casing 5 with several projections 6*a* that can rotate in this casing 5. The projections 6*a* carry radially projecting lugs or pins 14 which lock into guide and control grooves 13 of the holding casing 5 upon insertion in snap fashion. The pins 14 may also be provided on the casing 5 and the slots 13 on the sleeve 6. The slots 13 are helical with small pitch and of opposite inclination or hand so that they bring about in each case a self-inhibiting locking between the holding sleeve and the holding sleeve in end positions.

Figure 3:
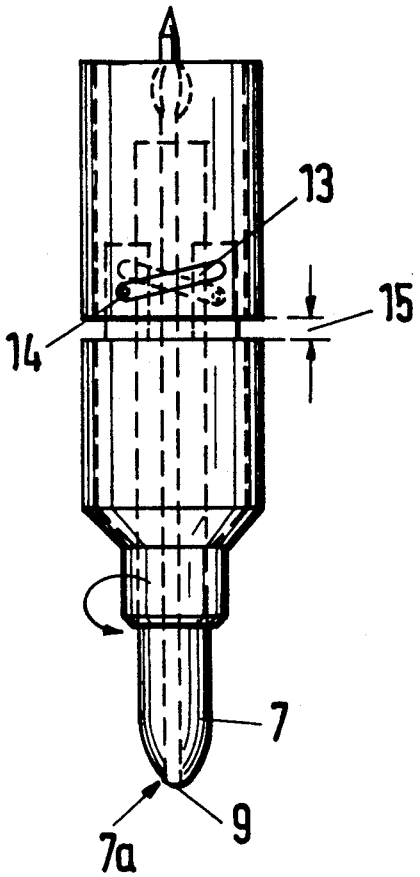
FIGS. 3 and 4 are a side view of two cooperating parts of the writing implement, namely in FIG. 3 in the writing position for the writing tip with large diameter and in FIG. 4 in the writing position for the small writing tip.
Figure 4:
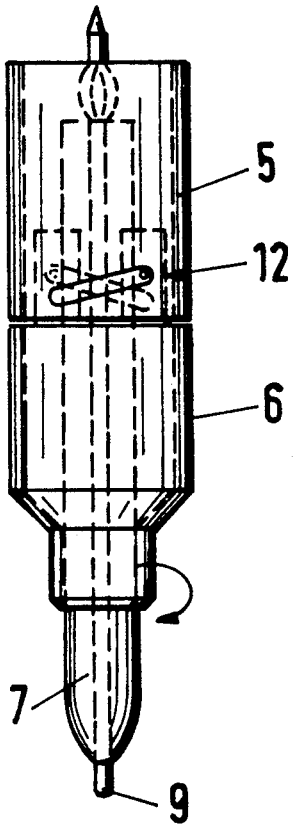

Relative rotation of the holding sleeve 6 with respect to the holding casing 5 outwardly displaces or inwardly retracts the holding sleeve 6 by an axial displacement path 15 that is a function of the length and the pitch of the slots 13 with respect to the holding casing 5. The large-diameter writing tip 7 takes part in this relative movement with respect to the small-diameter writing tip 9. In the outwardly shifted position of the holding sleeve 6 (FIG. 3) the contact area of the large-diameter writing tip 7 with a writing substrate is level with the end or the contact surface of the small-diameter writing tip 9 so that there is a continuous uniform contact surface 7*a* in this writing position (FIG. 3). Since in general the slim writing tip 9 is formed of a harder or stiffer material than the fat writing tip 7, the writing tip 9 also contributes in this writing position to stabilize the writing tip 7 and to reduce wear of its contact surface 7*a* so as to prolong the service life of the contact surface 7*a*. A relative pushing back of the holding sleeve 6 with respect to the holding casing 5, retracts the writing tip 7 with respect to the writing tip 9 so that the writing tip 9 is exposed (FIG. 4) and can be used to write without problems and in normal position of the writing implement with fine line thickness.

Figure 5:
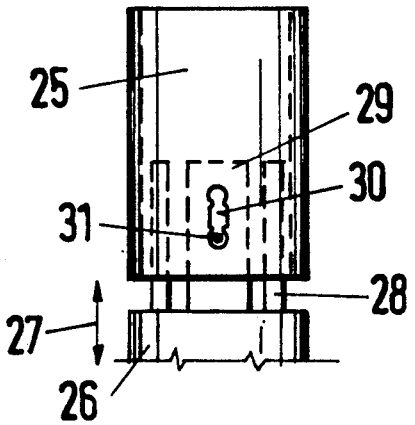
FIG. 5 is a lateral view and fragment of a modified embodiment of the new writing implement.
Figure 6:
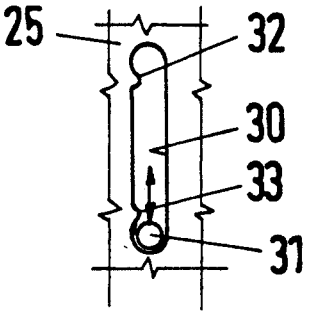
FIG. 6 is a detail of FIG. 5 in enlarged scale.

In the modified embodiment according to FIGS. 5 and 6 a casing 25 is formed with a slot 30 extending parallel to its axis. A pin 31 projecting radially from a projection 28 of a sleeve 26 equivalent to the sleeve 6 projects into this slot 30. Catches 32 and 33 associated with the end positions of the pin 3 are formed in the slot 30 and serve to hold the writing tips in the end positions used for writing.

The writing implement 41 according to FIGS. 7 to 10 consists of a writing implement body 42 in which a first writing material reservoir tampon 44*a* and a second reservoir tampon 44*b* for a different writing material are disposed concentrically to each other. The two writing material reservoir tampons 44*a* and 44*b* are separated from each other by a tube 50. The open end of the writing implement body 52 can be closed by a slip-on cap 43 as already described in the embodiment of FIGS. 1 through 3.

An insert 51 is force fitted into the open end of the writing implement body 42. This insert 5*a* is represented in FIGS. 8 to 10 in detail and on a larger scale. It consists of an outer sleeve which is force fitted into the writing implement body 42 and which is formed at its outwardly pointing end with oblique control slots 52. A central blade-shaped part 56 projecting from a transverse wall toward the interior is disposed in the interior of the insert 51. This central part 56 has a hollow mouthpiece 53 on which the separating tube 50 is placed sealingly and firmly. A small-diameter writing tip 48 projects through a bore 54 in the mouthpiece 53 and engages in the inner writing material reservoir tampon 44*b* and is in constant intimate contact with the writing material or ink therein. The writing tip 48 may have a separate outer writing tip portion 49. This writing element 48, 49 is held along most of its length by a separating sleeve 60. The inner end of this separating sleeve 60 is firmly and sealingly received in a corresponding bore of the part 56. In this fashion the inner writing material system is reliably and completely sealed with respect to the outer one and nevertheless a reliable flow of writing material from the reservoir tampon 44*b* to the outer writing tip 49 is possible.

As can be seen from FIG. 7 the outer writing material reservoir tampon 44*b* engages over the inner end portion 56 of the insert element 51 which also engages deeply into the outer writing material reservoir tampon 44*a*. This writing material reservoir tampon 44*a* has an inner bore open at the insert 51 in which an outer large-diameter writing tip 47 can slide to a limited extent axially while remaining in constant material exchange with the writing material reservoir tampon 44*a*. The outer writing tip 47 is supported by a holding sleeve 46 which engages with several axially inwardly projecting extensions 46*a* rotationally and axially displaceably into the open end of the insert 51. The extensions 46*a* are provided with radially projecting pins 52*a* which lock in snap fashion into control grooves 52 of the insert 51 upon insertion. On rotation the holding sleeve 46 is displaced axially with the large-diameter outer writing tip 47. It can thus be advanced with respect to the stationary inner writing tip 46 into a writing position or retracted with respect to the same into a nonuse position.

I claim:

1. A writing implement comprising:

a hollow body extending along and centered on an axis;

a reservoir tampon in the body holding a supply of ink;

a casing fixed in the body over the reservoir tampon;

a small-diameter core writing element having a rear end fixed in and projecting rearwardly through the casing into the reservoir tampon and a front end;

a sleeve slidable axially in the body adjacent and around the core element; and a large-diameter outer writing element formed with a central throughgoing small-diameter bore through which the core element extends slidably, the outer element having a rear end fixed in the slidable sleeve and projecting into the reservoir tampon and a front end, the sleeve and outer element being axially jointly displaceable between a forward position with the front end of the outer element level with the front end of the core element and a rear position with the front end of the core element projecting axially outward past the front end of the outer element.

2. The writing implement defined in claim 1 wherein the casing has a cross piece extending across the reservoir tampon and formed with a small-diameter aperture in which the rear end of the small-diameter core element is fixed.

3. The writing implement defined in claim 1 wherein the reservoir tampon includes an outer part engageable only with the outer large-diameter element and saturated with an ink of a predetermined color, an inner part in which only the core element is engaged and which is saturated with an ink of a color different from that of the outer part, and an impervious sleeve separating the reservoir parts from each other.

4. The writing implement defined in claim 3, further comprising an impervious protective sleeve surrounding the core element within the outer element.

5. The writing implement defined in claim 3 wherein the sleeve is provided with a crosspiece sealingly engaged with the impervious sleeve nd formed with a small-diameter aperture in which the rear end of the core element is fixed.

6. The writing implement defined in claim 1 wherein the reservoir tampon is formed with a forwardly open recess in which the rear end of the outer element is axially slidable while remaining in contact with the reservoir tampon.

7. The writing implement defined in claim 1, further comprising means including interengaging formations on the casing and on the sleeve for releasably retaining the casing and outer element in the forward and rear positions.

8. The writing implement defined in claim 7 wherein the formations include n angled groove and a radially projecting pin engaged therein.

9. The writing implement defined in claim 7 wherein the formations include an axially extending groove and a radially projecting pin engaged therein.

10. The writing implement defined in claim 8 wherein the groove is formed with stops engageable with the pin in the end positions thereof.

* * * * *

UNITED STATES PATENT AND TRADEMARK OFFICE

CERTIFICATE OF CORRECTION

PATENT NO. : 5 026 189

DATED : June 25, 1991

INVENTOR(S) : Georg Keil

It is certified that error appears in the above-identified patent and that said Letters Patent is hereby corrected as shown below:

Cover Page - first line referring to Assignee should read:

[73] Assignee: Firma Merz & Krell GmbH & Co.

Signed and Sealed this

Tenth Day of November, 1992

*Attest:*

DOUGLAS B. COMER

*Attesting Officer*

*Acting Commissioner of Patents and Trademarks*